US005105346A

United States Patent [19]

Acks et al.

[11] Patent Number: 5,105,346

[45] Date of Patent: Apr. 14, 1992

[54] METHOD AND APPARATUS FOR ILLUMINATING AN UNDERWATER ENVIRONMENT

[75] Inventors: Robert S. Acks; R. Bruce Fugitt, both of San Diego, Calif.

[73] Assignee: Remote Ocean Systems, Inc., San Diego, Calif.

[21] Appl. No.: 579,655

[22] Filed: Sep. 10, 1990

[51] Int. Cl.[5] ..... F21V 29/00

[52] U.S. Cl. ..... 362/267; 362/261; 362/263; 362/226; 362/310

[58] Field of Search ..... 362/261, 263, 226, 267, 362/310

[56] References Cited

U.S. PATENT DOCUMENTS

| | | | |
|---|---|---|---|
| 3,681,591 | 8/1972 | Loch | 362/217 |
| 3,949,212 | 4/1976 | Larrimore | 362/267 |
| 4,574,337 | 3/1986 | Poppenheimer | 362/267 |
| 4,683,523 | 7/1987 | Olsson et al. | 362/267 |
| 4,996,635 | 2/1991 | Olsson et al. | 362/267 |
| 5,016,151 | 5/1991 | Mula | 362/267 |

OTHER PUBLICATIONS

Letter from Commander Submarine Group 2 to Commander Submarine Force,U.S. Atlantic Fleet, dated Dec. 11, 1989.

Facsimile Received from Assignee's Agents in Scotland on Oct. 26, 1990.

Assignee's Sales Brochure, Distributed Beginning in 1986.

*Primary Examiner*—Ira S. Lazarus
*Assistant Examiner*—Sue Hagarman
*Attorney, Agent, or Firm*—Brown, Martin, Haller & McClain

[57] ABSTRACT

The underwater illumination apparatus has a high pressure sodium arc lamp sealed to a stainless steel base with a flexible, radiation-resistant potting material to provide both a watertight seal and a shock-absorbing connection. A wet-mateable base connector is attached to the base to permit connection to a lower cable. A transparent, impact-resistant cover is formed around the base and the arc lamp. The cover has holes through which water can flow in and out to conduct heat away from the arc lamp. The combination of the above elements creates a modular unit which is replaced as a whole when the arc lamp burns out. The lower cable which provides power to the arc lamp is attached at its other end to a ballast power supply which is hermetically sealed in a stainless steel housing. Wet mateable connectors are attached at the inlet and outlet of the ballast power supply to attach to the lower cable and to the upper cable connection to a 120 VAC source.

24 Claims, 1 Drawing Sheet

METHOD AND APPARATUS FOR ILLUMINATING AN UNDERWATER ENVIRONMENT

FIELD OF THE INVENTION

The present invention relates to illumination systems and more particularly to illumination systems for hazardous underwater environments.

BACKGROUND OF THE INVENTION

A large number of reasons exist for lighting a large underwater environment including security, safety and illumination of work surfaces. Applications include oil drilling platforms, lighting around submarines and ships and for storage pools. In all applications it is desirable to use a high efficiency, long lifetime light source which can provide continuous lighting with minimal maintenance. Nowhere is the need for a low maintenance lighting system more important than in nuclear spent fuel storage pools and in nuclear reactor vessels in which water is used to slow the reaction rate, and service of the lighting system results in radiation exposure for maintenance personnel.

Typically, these pools require a large number of lights for effective illumination. Traditionally this lighting is accomplished using 1000 W, 120 V incandescent spotlights or floodlights. These bulbs have lifetime ratings of 2,000 to 4,000 hours, and provide total light output of 17,000 lumens. At a lifetime of 4,000 hours, a particular light fixture will require 2.19 bulb changes per year, with maintenance personnel being exposed to radiation at each bulb change. A typical fuel storage pool uses 50 incandescent light fixtures.

High pressure sodium (HPS) lighting has been used extensively for street and parking area illumination, lighting in factories and for security lighting. The primary advantages of HPS lights are 1) high efficiency and 2) very long lifetime. Compared to an incandescent bulb, an HPS bulb has a lifetime rating of 24,000 hours and provides a total light output of 140,000 lumens.

SUMMARY OF THE INVENTION

It is an advantage of the present invention to provide an apparatus and method for illuminating underwater environments using high pressure sodium (HPS) lights. In an exemplary embodiment, the underwater illumination apparatus has a high pressure sodium arc lamp sealed to a stainless steel base with a flexible, radiation-resistant potting material to provide both a watertight seal and a shock-absorbing connection. A wet-mateable base connector is attached to the base to permit connection to a lower cable. A transparent, impact-resistant cover is formed around the base and the tube. The cover has holes through which water can flow in and out to conduct heat away from the arc tube. The combination of the above elements creates a modular unit which is replaced as a whole when the arc lamp burns out.

The lower cable which provides power to the arc lamp has a connector which mates with the base connector. The lower cable is attached at its other end to a ballast power supply which is hermetically sealed in a stainless steel housing. Wet-mateable connectors are attached at the inlet and outlet of the ballast power supply to attach to the lower cable and to the upper cable connection to a 120 VAC source.

A highly-polished reflector partially surrounds the modular unit to provide directional lighting capability. All components are mounted on a pole by which the apparatus may be suspended into the water.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DETAILED DESCRIPTION OF THE PREFERRED EMBODIMENT

Figure 1:
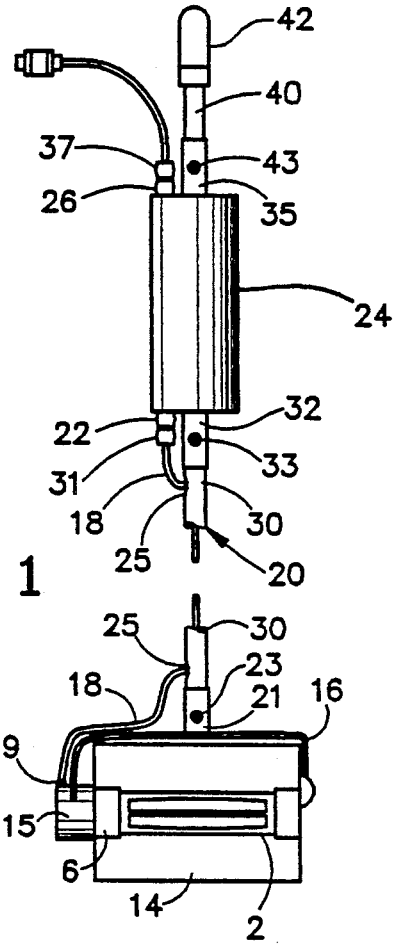
FIG. 1 is a diagrammatic front elevation of a first embodiment of the illumination apparatus.
Figure 2:
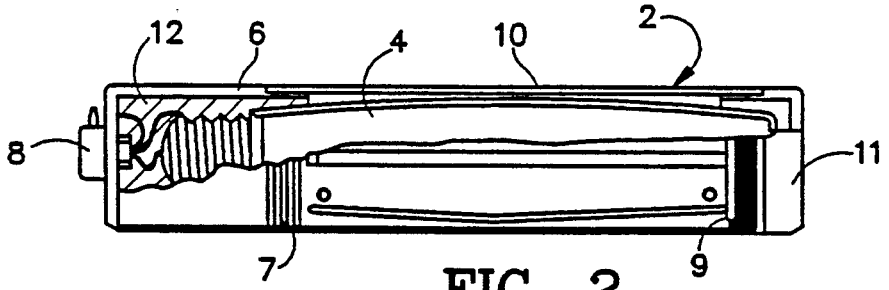
FIG. 2 is a side elevation partially cut away of the modular lighting unit.

As shown in FIGS. 1 and 2, modular lighting unit 2 comprises arc lamp 4, base 6, connector 8 and transparent cover 10. Potting material 12 seals the connection between arc lamp 4 and base 6. A reflector 14 partially surrounds modular lighting unit 2 and is supported by yoke 16 to permit pivoting of reflector 14. Lower cable 18 mates with connector 8 and runs up pole 20 to mate with lower connector 22 of ballast power supply 24. Ballast power supply 24 is mounted on pole 20. Upper connector 26 mates with upper cable 28 which provides connection to a 120 VAC source.

The components of modular lighting unit 2 are permanently assembled to provide a watertight seal between the arc lamp 4 and base 6. Base 6 is preferably made of stainless steel with soldered or welded wire connections. On the outer end of base 6 connector 8 is attached. Connector 8 is a low profile wet-mateable connector so the modular unit 2 may be changed underwater without drying the connectors. The base 6 is filled with potting material 12 to cover the end of arc lamp 4 providing a permanent waterproof bond. Potting material 12 is flexible, radiation tolerant and retains its effectiveness at high temperatures. A suggested material is silicone sealant.

Arc lamp 4 is preferably a high pressure sodium arc lamp chosen for its long lifetime and highly-efficient light output. Such a bulb is rated at 24,000 hours lifetime with an output of 140,000 lumens for a 1000 watt bulb. For situations where lower light output is desired, a lower wattage rating high pressure sodium or a low pressure sodium bulb may be used. Other types of arc lamps are available at different wattage ratings and may be used, including mercury vapor and thallium-iodide-doped mercury vapor to provide high-efficiency, long lifetime lighting. Use of mercury vapor lamps in nuclear pools is generally undesirable due to the potential for attack of stainless steel by mercury. However, mercury vapor lights, especially thallium-iodide doped lights, have the advantage of lower absorption of the emitted wavelength of light in water than sodium lights, so mercury vapor may be desirable for use in non-nuclear, clear water applications.

Transparent cover 10 is constructed of an impact-resistant polycarbonate such as LEXAN or other similar impact-resistant material. Cover 10 has internal threads 11 at both ends to mate with external threads 7 of base 6 and external threads 9 of end plug 11. End plug 11 is preferably made of stainless steel. The arc lamp 4 is supported within the cover 10 so that it does not touch the inner surfaces of cover 10 or end plug 11. The arc lamp 4 is suspended so that shock is not transferred if the cover 10 is struck and to avoid melting the cover 10 if is should come in contact with the arc lamp 4. To provide cooling of arc lamp 4, several holes are made in cover 10 to permit water to enter and exit modular unit 2.

Reflector 14 is generally parabolic in shape with modular unit 2 centered at its focus. The inner surface is highly polished to provide a high-efficiency reflection. Reflector 14 is held in place by yoke 16 which is rotatably attached at opposite ends of the reflector to permit pivoting of the reflector in a vertical direction. Reflector 14 has a cylindrical extension 15 which is open and has an inner diameter slightly larger than the outer diameter of modular unit 2. An opening 17 in an upper portion of cylindrical extension 15 permits insertion of connector 19 of lower cable 18 to mate with connector 8.

Figure 4:
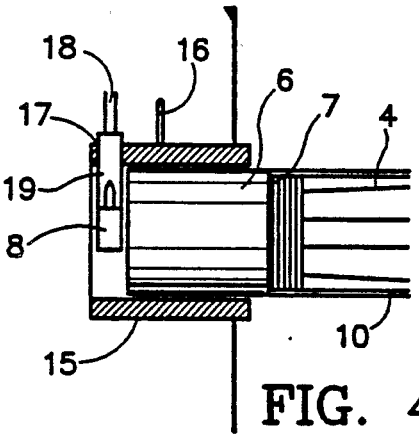
FIG. 4 is a cross-sectional view taken along line 4—4 of FIG. 5.

For changing modular unit 2, connector 19 is disconnected so that modular unit 2 can be slid out through cylindrical extension 15. A new modular unit 2 is inserted into cylindrical extension 15 so that attachment of mating connectors 8 and 19 to lock the modular unit 2 in place as shown in FIG. 4.

Extending upward from yoke 16 is socket 21 into which pole 20 inserts and locks using quick-release pin 23. If replacement of the reflector 14 and modular unit 2 is required, connectors 8 and 19 are detached and pin 23 is released to remove the entire light head as a unit.

Pole 20 is a hollow pipe which has openings 25 in its side to permit entry and exit of cable into and out of pole 20. The lower pole section 30 inserts into socket 32, held in place by quick-release pin 33. Lower cable 18 runs up lower pole section 30 exiting through opening 25 so that connector 31 can mate with lower connector 22 of ballast power supply 24.

Ballast power supply 24 converts the 120 VAC input signal into a constant current supply for driving arc lamp 4. For underwater mounting and operation, ballast power supply 24 is hermetically sealed in a stainless steel housing to permit reliable watertight operation. Lower connector 22 and upper connector 26 are wet mateable with connectors 31 and 37 respectively. The upper portion of ballast power supply 24 has a socket 35 into which upper pole section 40 inserts and is held in place by quick-release pin 43. The use of wet mateable connectors and quick-release pins at both input and output permit ballast power supply 24 to be replaced as a unit as needed. In an alternate embodiment, where ballast power supply 24 is in air, mounted on a pole or structure sufficiently remote from the water, a weatherproof steel enclosure may be used.

Upper pole section 40 has a lift bail 42 made preferably of stainless steel to facilitate handling and hanging of the assembly from the side of a floating platform or the side of a tank.

Upper cable 28 provides electrical connection between ballast power supply 24 and a 120 VAC source.

Lower cable 18 and upper cable 28 are preferably polyurethane covered for radiation tolerance, durability and easy decontamination. The modular design of the cables facilitates replacement if they are damaged.

Figure 3:
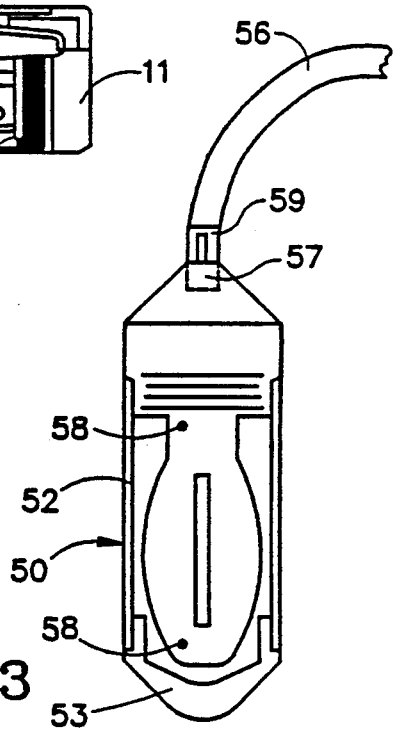
FIG. 3 is a diagrammatic side view of a second embodiment.

In a second embodiment shown in FIG. 3, a modular unit 50 is constructed in a similar manner to modular unit 2 of the first embodiment. A variation is made in the shape of the ends of transparent cover 52 so that they are generally conical. End cap 53 may be either stainless steel or of the same polycarbonate material as transparent cover 52 with a threaded fastening means similar to that previously described.

The modular unit 50 is not mounted on a pole, rather it is left to freely hang on cable 56. The ballast power supply may be placed in or out of the water, depending on the type of enclosure selected, with the requirement that cable 56 be long enough to permit mobility of the light. The use of the second embodiment is that of an underwater high-efficiency drop light. The generally smooth conical ends of the modular unit 50 make it easier to pass the light through narrow passages in which an edge might catch. A drop light so designed has a long lifetime and has protection against bulb breakage due to impact. If the bulb should still happen to break, the glass fragments will be contained within transparent cover 52. As in the first embodiment, small openings 58 are provided in the transparent cover 52 to permit water to flow through modular unit 50. The drop light will have cable 56 directly attached to modular unit 50 in the preferred embodiment. In an alternate form, a connection is provided so that when the lamp burns out, modular unit 50 is replaced by disconnecting connectors 57 and 59, selecting a new unit and reconnecting connectors 57 and 59.

Figure 5:
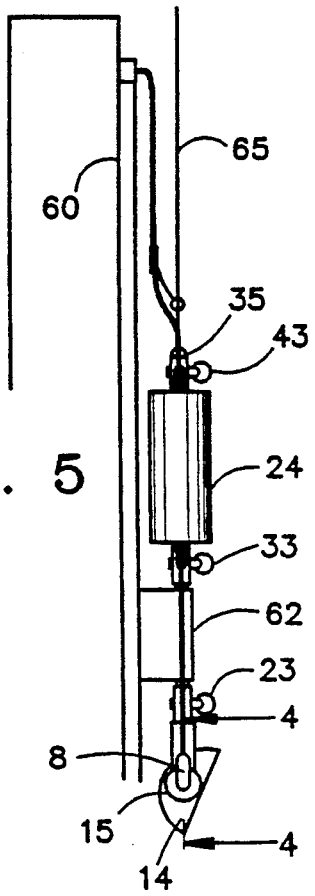
FIG. 5 is a diagrammatic side elevation of a third embodiment of the present invention.

In a third embodiment of the present invention shown in FIG. 5, the components of the first embodiment are mounted on a track 60 and carriage 62 which permit remote-controlled raising and lowering of the lighting apparatus. The upper cable 64 must be long enough to permit full travel down the track. A stainless steel lift cable 65 provides the force for moving the assembly.

The above-described apparatus and method for illuminating an underwater environment are intended for direct replacement of existing incandescent lighting in nuclear pools. The design provides greatly-improved reliability with a minimal amount of maintenance using already-available power sources. Because of the higher efficiency and service lifetime, the operating and maintenance costs are substantially lower. Most importantly, the exposure of maintenance personnel to radiation and other hazards in the underwater environment is drastically reduced.

It will be evident that there are additional embodiments which are not illustrated above but which are clearly within the scope and spirit of the present invention. The above description and drawings are therefore intended to be exemplary only and the scope of the invention is to be limited solely by the appended claims.

We claim:

1. An apparatus for illuminating an underwater environment comprising:

an arc lamp for emitting light;

a base for mating with and for conducting electricity to said arc lamp;

a potting material for fixedly sealing said arc lamp to said base and for creating a watertight seal between said arc lamp and said base;

a transparent impact-resistance cover for enclosing said arc lamp, said base and said potting material;

a releasable connector attached to said base;

a cable means for providing electricity to said connector;

a ballast power supply container in a watertight housing and connected to said cable means, whereby said arc lamp, said base, said potting means and said transparent cover are a unit for purposes of replacement so that replacement is accomplished by disconnecting said releasable connector from said an old said unit and connecting it to a new said unit; and a polished reflector, partially surrounding said unit to permit variation in the direction of the reflection of light emitted from said arc lamp.

2. An apparatus as in claim 1 wherein said conductive connector is wet mateable.

3. An apparatus as in claim 2 wherein said ballast power supply is hermetically sealed in a watertight housing.

4. An apparatus as in claim 1 wherein said ballast power supply is located in air, remote from said underwater environment.

5. An apparatus as in claim 1 wherein a plurality of vent holes are provided in said transparent cover to permit water to flow around said arc lamp.

6. An apparatus as in claim 1 wherein said arc lamp comprises a high pressure sodium arc lamp.

7. An apparatus as in claim 1 wherein said arc lamp comprises a low pressure sodium arc lamp.

8. An apparatus as in claim 1 wherein said arc lamp comprises a mercury vapor lamp.

9. An apparatus as in claim 1 wherein an inner surface of said transparent cover is separated at all points from said arc lamp to minimize transfer of impact from said transparent cover to said arc lamp.

10. An apparatus as in claim 1 wherein said unit, said polished reflector and said ballast power supply are mounted on at least one pole whereby at least a portion of said apparatus is suspended in said underwater environment.

11. An apparatus as in claim 10 wherein said unit, said polished reflector and said ballast power supply are slidably mounted on a track.

12. A method for illuminating an underwater environment which permits rapid replacement of burned-out light sources to lessen exposure of maintenance personally to hazards of said underwater environment which comprises:

selecting an arc lamp as a light source;

selecting a base for mating with and for conducting electricity to said arc lamp;

sealing said arc lamp to said base with a potting material to provide a permanent watertight seal;

enclosing said arc lamp, said base and said potting material in a transparent impact-resistant cover to create a unit;

partially surrounding said unit with a polished reflector to permit variation in the direction of the reflection of light;

selecting a releasable connector for attachment to said base;

attaching a cable means to said releasable connector; and selecting a ballast power supply for connection to said cable means for providing electrical power to said arc lamp whereby said unit may be replaced by disconnecting said releasable connector, inserting a new said unit and connecting said releasable connector of said new unit.

13. A method as in claim 12 wherein the step of selecting a releasable connector includes selecting a wet mateable connector.

14. A method as in claim 12 wherein the step of selecting a ballast power supply includes selecting a ballast power supply sealed in a watertight housing.

15. A method as in claim 12 wherein the step of enclosing said arc lamp, said base and said potting material in a transparent impact-resistant cover includes providing a plurality of vent holes in said cover to permit water to flow around said arc lamp.

16. A method as in claim 12 wherein the step of selecting an arc lamp includes selecting a high pressure sodium arc lamp.

17. A method as in claim 12 wherein the step of selecting an arc lamp includes selecting a low pressure sodium arc lamp.

18. A method as in claim 12 wherein the step of selecting an arc lamp includes selecting a mercury vapor lamp.

19. A method as in claim 16 further comprising mounting said unit, said polished reflector and said ballast power supply on at least one pole for suspension in said underwater environment.

20. A method as in claim 12 wherein the step of enclosing said arc lamp, said base and said potting material in a transparent impact-resistant cover includes shaping said cover in a cylinder with at least one generally conical end.

21. A method for replacement of an existing incandescent light system in a hazardous underwater environment which uses the same source of electricity, provides greater efficiency and lessens exposure of maintenance personnel to said underwater environment which comprises:

selecting a sodium arc lamp as a light source;

selecting a base for mating with and conducting electricity to said sodium arc lamp;

sealing said sodium arc lamp to said base with a potting material to provide a permanent watertight seal;

enclosing said sodium arc lamp, said base and said potting material in a transparent impact-resistance cover to create a unit;

partially surrounding said unit with a polished reflector to permit variation in the direction of the reflection of light;

selecting a releasable connector for attachment to said base;

attaching a cable means to said releasable connector; and selecting a ballast power supply for connection to said cable means for providing electrical power to said sodium arc lamp whereby said unit may be replaced by disconnecting said releasable connector, inserting a new said unit and connecting said releasable connector of said new unit.

22. A method as in claim 21 wherein the step of enclosing said sodium arc lamp, said base and said potting material in a transparent impact-resistant cover includes providing a plurality of vent holes in said cover to permit water to flow around said bulb.

23. A method as in claim 21 wherein the step of selecting a ballast power supply includes selecting a ballast power supply sealed in a watertight housing.

24. A method as in claim 23 further comprising mounting said unit, said polished reflector and said ballast power supply on at least one pole for suspension in said underwater environment.

* * * * *

UNITED STATES PATENT AND TRADEMARK OFFICE

CERTIFICATE OF CORRECTION

PATENT NO. : 5,105,346

DATED : April 14, 1992

INVENTOR(S) : Robert S. Acks and R. Bruce Fugitt

It is certified that error appears in the above-identified patent and that said Letters Patent is hereby corrected as shown below:

Column 5, Line 14, "Claim 2" should read --Claim 1--.

Column 6, Line 20, "Claim 16" should read --Claim 14--.

Signed and Sealed this

Fifth Day of October, 1993

*Attest:*

*Attesting Officer*

BRUCE LEHMAN

*Commissioner of Patents and Trademarks*